United States Patent [19]

Szarka et al.

[11] 3,955,761

[45] May 11, 1976

[54] METHOD FOR PROVIDING A VEHICULAR SUPPORTING DECK FOR A RAILROAD GRADE CROSSING

[75] Inventors: Paul J. Szarka; Joseph R. Szarka, both of Livonia, Mich.

[73] Assignee: Szarka Enterprises, Inc., Livonia, Mich.

[22] Filed: Jan. 2, 1975

[21] Appl. No.: 538,134

Related U.S. Application Data

[62] Division of Ser. No. 338,047, March 5, 1973, abandoned.

[52] U.S. Cl. ..... 238/8; 104/11; 238/2

[51] Int. Cl.[2] ..... E01B 1/00

[58] Field of Search ..... 238/2, 3, 6, 7, 8, 283; 104/11

[56] References Cited

UNITED STATES PATENTS

| | | | |
|---|---|---|---|
| 2,875,953 | 3/1959 | Weber et al. | 238/7 |
| 3,056,555 | 10/1962 | Eisses | 238/8 |
| 3,432,098 | 3/1969 | Sato | 238/283 |
| 3,465,963 | 9/1969 | Caillet et al. | 238/8 |
| 3,825,184 | 7/1974 | Hartl | 238/8 |

*Primary Examiner*—M. H. Wood, Jr.
*Assistant Examiner*—Richard A. Bertsch
*Attorney, Agent, or Firm*—Harness, Dickey & Pierce

[57] ABSTRACT

A method and apparatus for forming a railroad grade crossing comprising a vehicular supporting structure formed by a plurality of precast slabs fixedly located between and on opposite sides of a pair of running rails. A variety of slabs are provided for accommodation of multiple, switch and curved sections of track, with each slab being adjustably positioned relative to the elevation of the rails by temporary shims located proximate each of the marginal corners thereof and carried on the longitudinally spaced railroad ties. A supporting bracket is provided for fixedly connecting the slabs to the running rail. The structure is subsequently supported on a plurality of initially deformable pads located on the railroad ties and which are compressed and preformed to accommodate all inconsistencies and irregularities of the ties. In installations involving signal control sections of track, the supporting bracket is insulated from the running rails whereby to preclude any interference therewith.

9 Claims, 9 Drawing Figures

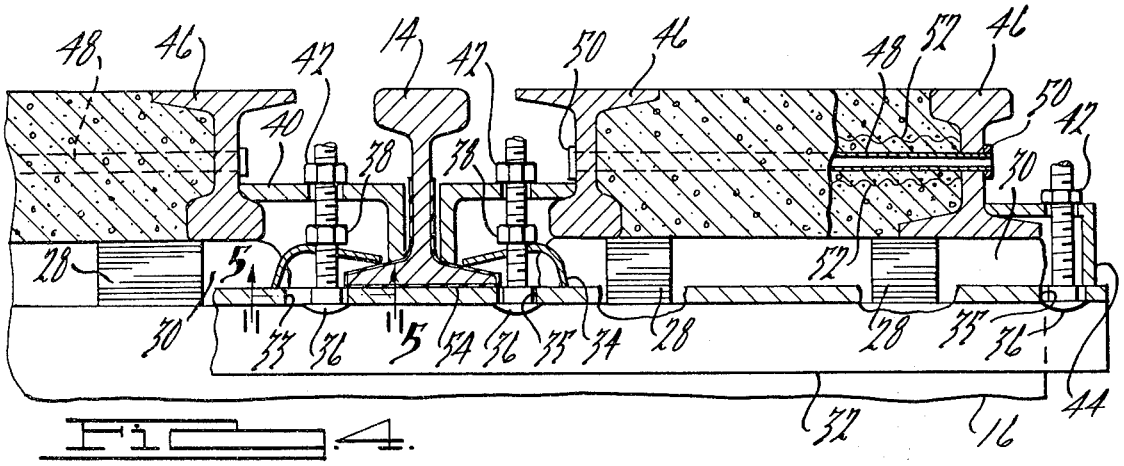
FIG. 4.
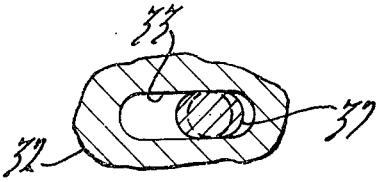
FIG. 5.
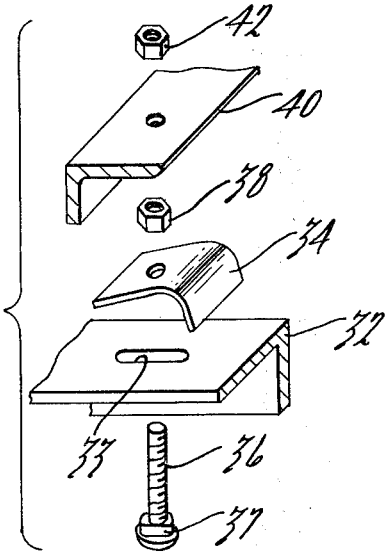
FIG. 6.
FIG. 8.
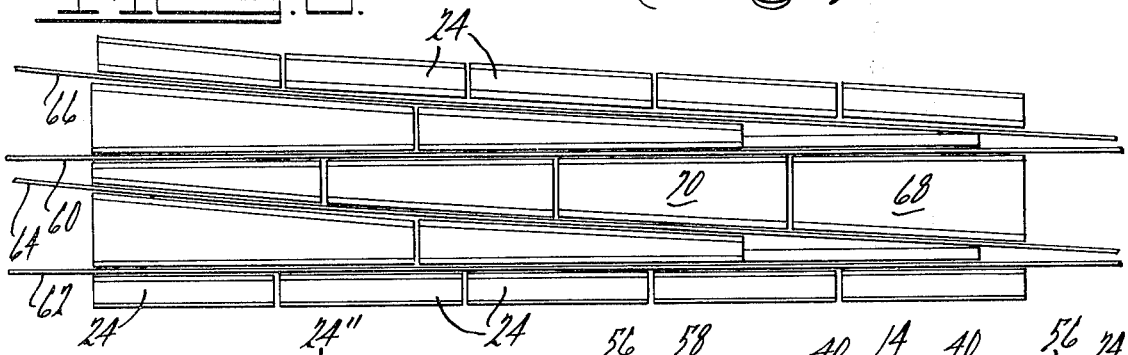
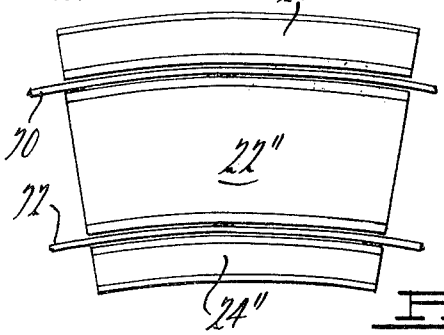
FIG. 9.
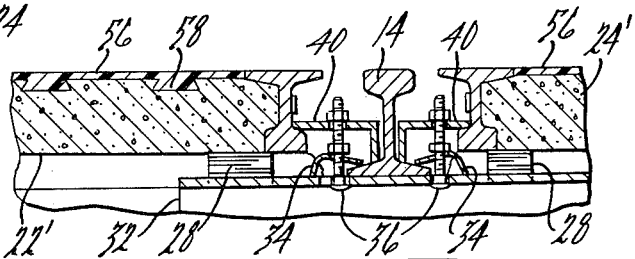
FIG. 7.

METHOD FOR PROVIDING A VEHICULAR SUPPORTING DECK FOR A RAILROAD GRADE CROSSING

This is a division of application Ser. No. 338,047, filed Mar. 5, 1973, now abandoned.

BACKGROUND AND SUMMARY OF THE INVENTION

This disclosure relates generally to railroad grade crossings, and more particularly to an improved vehicular supporting structure formed by a plurality of precast slabs adapted to be assembled at the job site.

Heretofore, various vehicular supporting structures have been proposed for installation at railroad grade crossings. Generally speaking, the structures themselves have been constructed from such materials as wood, concrete, steel, and various rubber compositions. Structures of wood and concrete are installed for substantially the same unit cost, but a disadvantage with respect to the former, is the cost of maintenance whereas the disadvantage of the latter, is the tendency to break-up or crack when subjected, over a period of time, to railroad and vehicular traffic. Steel structures are installed for approximately twice the cost relative to structures formed of wood and concrete, and the structures formed from the rubber compositions have been found to be about three (3) times more expensive than the steel or about six (6) times more expensive than structures formed of wood and concrete.

In the subject invention, the structure is formed by a plurality of reinforced concrete slabs with each including a pair of rail sections secured on opposite lateral sides thereof. The rail sections expand and contract in direct proportion with the running rails with minimum effect on the reinforced concrete. For a disclosure of a generally analogous slab, reference may be had to U.S. Letters Pat. No. 3,341,123 to M. Holthausen, that patent being incorporated herein by reference. The unit cost of the structure is comparable to that of wood or concrete and correspondingly, less expensive than either of the structures utilizing steel or the rubber composition. It is, therefore, a general object of the subject invention to provide a vehicular supporting structure which is highly competitive relative to all heretofore known installations at grade crossings.

Another disadvantage of prior known vehicular supporting structures for railroad grade crossings resides in the fact that the structure itself is connected to the railroad ties. As will be appreciated, railroad ties are irregularly spaced at intervals which have been found to vary between 18 to 26 inches thereby necessitating either advance track preparation or the installation of special cross ties to accommodate the installation of the supporting structure. Moreover, the outer surface of railroad ties are irregular and can require the use of special pre-fabricated shims to facilitate locating the slabs of the supporting structure relative to the elevation of the running rails. In the subject invention, the slabs are connected to the running rails themselves and supported by a plurality of deformable pads preferably located on every other railroad tie. Each pad is formed by filling a relatively flexible bag with a mortar of putty-like consistency which is adapted to compress, preform, and set whereby to accommodate all inconsistencies and irregularities of the individual ties. During the period while the pads are setting, the individual slabs are supported by one or more temporary standard shim elements which are supported by alternate or every other railroad tie relative to the ties supporting the pads. It is, therefore, a primary object of the subject invention to provide a vehicular supporting structure of the above indicated character which obviates the need for special advance track preparation including the installation of any specially formed cross ties or special pre-fabricated shims.

It is another object of the present invention to provide a vehicular supporting structure for a railroad grade crossing which is easily insulated from the running rails to permit installation thereof in signal control sections of track.

It is a further object of the present invention to provide a vehicular supporting structure of the above described character which can be also adapted for installation with multiple, switch, and curved sections of track.

Other objects, features, and advantages of the present invention will become apparent from the following detailed description taken in conjunction with the accompanying drawings.

BRIEF DESCRIPTION OF THE DRAWINGS

FIG. 4 is an enlarged cross-sectional elevational view of the right end of FIG. 3, and with the running rail insulated from the supporting deck;

FIG. 5 is a transverse cross-sectional view through the bottom plate or bracket illustrated in FIG. 4 taken on the lines 5-5 thereof;

FIG. 6 is an exploded view of the bracket assembly illustrated in FIG. 4;

FIG. 7 is a cross-sectional view similar to FIG. 4 illustrating another type of precast slab utilized in forming the vehicular supporting deck;

FIG. 8 is a plan view of an exemplary switch location illustrating another application of the vehicular supporting deck in accordance with the present invention; and FIG. 9 is a plan view of an exemplary section of track again illustrating still another application for a vehicular supporting deck in accordance with the present invention.

DETAILED DESCRIPTION OF THE PREFERRED EMBODIMENTS

Figure 1:
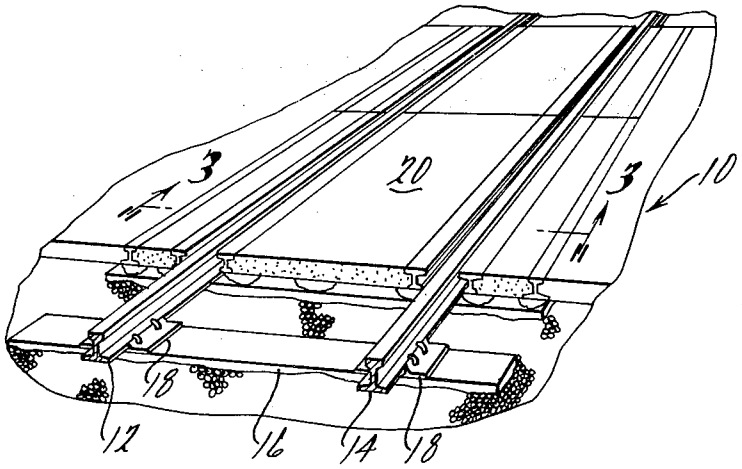
FIG. 1 is a perspective view of an exemplary railroad crossing illustrating a vehicular supporting structure or deck in accordance with the present invention.
Figure 3:
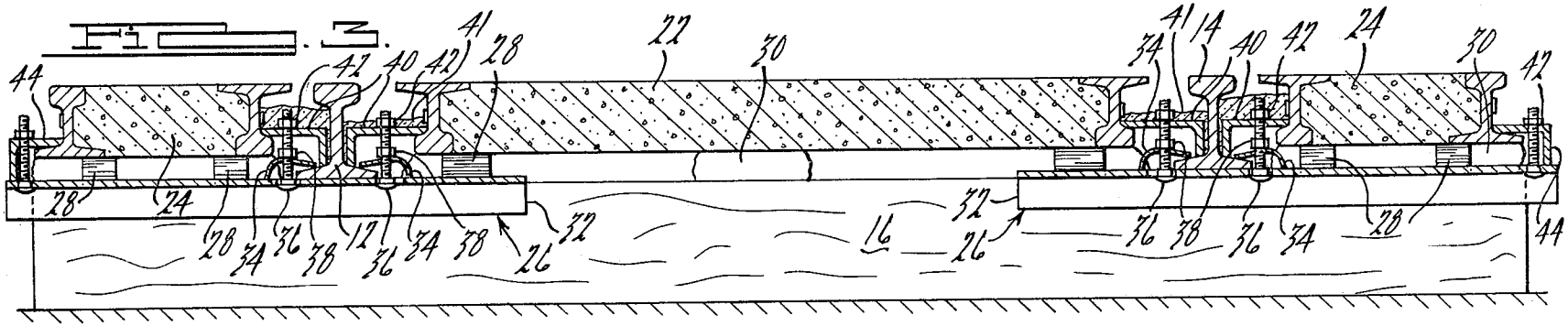
FIG. 3 is a cross-sectional elevational view of the grade crossing illustrated in FIG. 1 taken along the lines 3—3 thereof.

With reference now to FIG. 1 of the drawings, an exemplary grade crossing is indicated generally at 10 comprising a pair of laterally spaced running rails 12 and 14 supported on suitable longitudinally spaced railroad ties 16. The rails 12 and 14 are each affixed to the ties 16 by suitable mounting brackets 18 as is conventional in the art. A vehicular supporting structure or deck in accordance with the present invention is indicated generally at 20, and includes modular sections which are located between and suitably adjacent to opposite lateral sides of the rails 12 and 14 whereby to permit vehicular traffic or the like to smoothly traverse the grade crossing 10.

Figure 2:
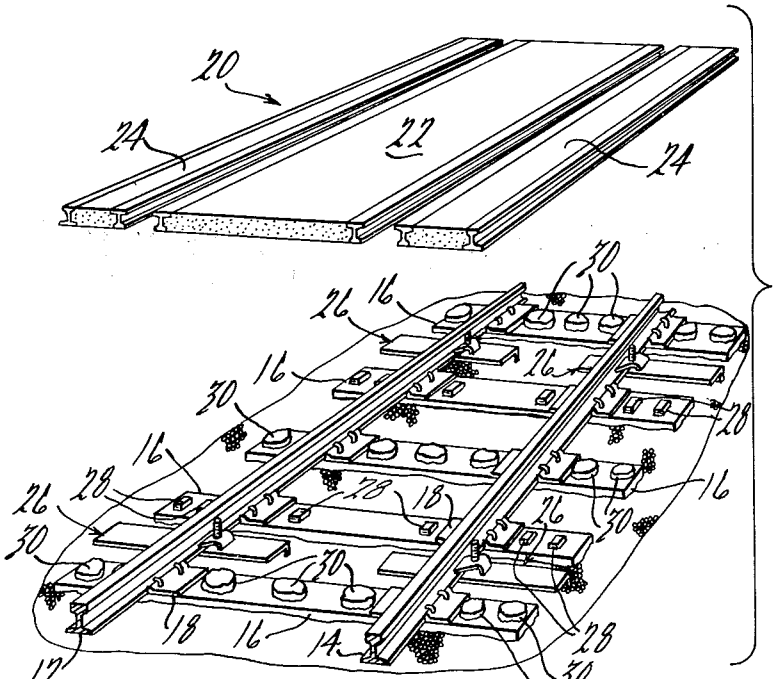
FIG. 2 is an exploded view of the grade crossing illustrated in FIG. 1, showing the various elements utilized for securing and supporting the deck.

As best seen in FIG. 2, the exemplary section of the vehicular supporting deck 20 is comprised of a center precast slab or plate 22 and a pair of precast slabs 24, each of the slabs 22 and 24 preferably having a standard length of approximately 8 feet. Although only one section of the deck 20 is illustrated, it will be appreciated that a sufficient number of sections are provided in end to end abutting relationship to extend totally across the grade crossing 10. In the subject invention, the slabs 22 and 24 are fixedly connected to the rails 12 and 14 by a plurality of bracket assemblies 26 which shall hereinafter be described in detail. The slabs 22 and 24 are initially supported by a plurality of leveling shims 28 located on alternate or every other railroad tie 16, the shims 28 being provided in predetermined incremental thicknesses whereby to adjust the top surface of each of the slabs 22 and 24 in elevational alignment relative to the top surface of the running rails 12 and 14 and provide a temporary support therefor. The slabs 22 and 24 are also supported by a plurality of pads or columns 30, positioned at selective locations on the railroad ties 16 and with each pad 30 being comprised of a flexible or deformable bag filled with a non-shrinkable, non-metallic grout material. In the embodiment illustrated in FIG. 2 and by way of example, an eight foot center slab 22 is supported by nine pads 30, which are disposed in rows of three on every other or alternate ties 16. On the other hand, each of the end slabs 24 are preferably supported by six pads 30, two columns 30 being located on alternate ties 16. It will be noted, however, that the number of pads 30 indicated above have been found to adequately support an eight foot section of slab whereas more or fewer pads can be utilized for supporting slabs of varying configuration and length.

In the subject invention, the weight of the slabs 22 and 24 is directly applied to the pads 30 which are compressed until the slabs 22 and 24 are supported by the shims 28. In this position, the pads 30 also conform to the configurations of the railroad ties 16 whereby to accommodate all inconsistencies and irregularities of the ties. Moreover, it is desirable to locate the pads 30 supporting the outer marginal edges of the slabs 22 and 24 with a certain degree of care to preclude any tendency thereof to rock or shift when subjected to vehicular traffic. With respect to the grout or mortar utilized to fill the bags, it is preferred that a material be selected which can set up in from six to twelve hours and which is substantially unshrinkable.

With reference to FIGS. 3, 4, 5, and 6, the slabs 22 and 24 are fixedly connected to the rails 12 and 14 by the bracket assembly 26. The assembly 26 includes a base plate 32 which can be fabricated from a section of angle iron stock. The plate 32 is provided with a first elongated aperture 33 and a pair of laterally spaced apertures 35 which are spaced, respectively, in conformance with the width of the flange of the running rail 14 and the width of the end slab 24. The elongated slot 33 permits the plate 32 to be utilized with running rails having flanges of varying width, whereas the apertures 35 are formed to cooperatively receive a generally oval shaped locator section 37 of a track bolt 36, the section 37 having a pair of oppositely spaced flat sides dimensioned to be snuggly received in the apertures 33 and 35, whereby to preclude rotational movement of the bolt 36. The base plate 32 is connected to the flange of the running rails 12 and 14 by a pair of rail clips 34, each clip being secured by a suitable nut 38 threadably engaged to the bolt 36. The adjacent marginal edges of the slabs 22 and 24, relative to the running rails 12 and 14, are immovably retained or secured by a pair of angle shaped hold-down brackets 40, the latter also being retained by the bolts 36 via a suitable anti-vibration lock nut 42. Correspondingly, the outer marginal edges of each of the slabs 24, are similarly retained to the base plate 32 via assembly of an end bracket 44, a track bolt 36 and a lock nut 42. If desired, the space between the marginal edges of the slabs 22 and 24 and the running rails 12 and 14 may be filled by a suitable material indicated at 41 which, by way of example, can be a rubber or bituminous filter.

As previously indicated, each of the center and end slabs 22 and 24 are preferably cast in eight foot modular sections with each section having a depth or height of 5 or 6 inches whereby to facilitate installation with all forms of standard rail sections. Each of the modular slabs 22 and 24 are precast of one-piece monolithic construction and dimensioned to provide a 2¼ to 2½ inch flangeway opening between opposite lateral sides of the head section of the running rails and the adjacent marginal outer edges of the slabs. Each of the slabs 22 and 24 include a pair of laterally spaced rail sections 46 which function to encase, armor and reinforce the slabs. The rails 46 are held to gauge by a plurality of spaced tie rods, preferably three, each of the rods 48 projecting through suitably formed apertures formed in the web of the rails 46 and connected thereto by suitable washer elements 50 welded to the rods 48. Preferably, the concrete design develops 6,000 psi strength and is reinforced, top and bottom, by a wire mesh indicated in FIG. 4 generally at 52.

The subject invention may also be used in a signal control section of track without interfering with the various control boxes and signals. In this regard and with reference to FIG. 4, the assembly 26 can be insulated from the running rail by wrapping a sheet of insulated material 54 around the outer peripheral surface of the web and lower flange portions of the running rails prior to installation of the bracket assembly 26. The wrapping 54 prevents metal to metal contact between the confronting or engaging edges of the base plate 32, the rail clips 34, and the hold-down bracket 40. In like manner, all of the bracket assemblies 26 utilized within the control sections of track, can be insulated from the running rails 12 and 14 whereby the signal control section is virtually uneffected by the installation of the structure 20 at the grade crossing 10.

Another form of modular slab is illustrated in FIG. 7, wherein identical components are designated by the same numerals previously utilized in FIGS. 1–6 and wherein modified components are designated with the same numerals but with the addition of a prime (′) suffix. The basic structure illustrated in FIG. 7, can be identical to the embodiment illustrated in FIGS. 1–6 with the exception of the center and end slabs 22′ and 24′ respectively. Dimensionally, the slabs 22′ and 24′ are identical to the slabs 22 and 24 but include a solid urethane elastomer pad 56 on an upper surface thereof. The pad 56 is integrally cast and bondingly connected to the concrete. In this regard the pad 56 includes a plurality of laterally spaced, wedge shaped tongues 58 which are located in complementary grooves or recesses formed in the concrete whereby to be made an integral part thereof.

Each of the slabs 22 and 24 or 22′ and 24′ are assembled at the job site in accordance with the following method of installation. Initially, the height from the top of the ties 16 to the top of the rail 12 and 14 is measured and the thickness of the slabs 22 and 24 is deducted therefrom, to establish the thickness of the shims 28. The bracket assemblies 26 are disposed on the under side of the rails 12 and 14 between adjacently located ties 16 and are secured to the rail flange via the rail clips 34 and the bolts 36 and nuts 38. Properly dimensioned shims 28 are then suitably located on the railroad ties 16 at preselected locations adapted to support the slabs 22 and 24. A suitable grout or mortar is then mixed to a putty-like consistency and the mortar bags are filled to form the pads 30 which are selectively placed on alternating ties 16 relative to the ties 16 supporting the shims 28. The precast slabs 22 and 24 are subsequently disposed on the shims 28 and adjusted to correct the flangeway opening between the running rails 12 and 14 and the adjacently located reinforcing rails 46 forming the marginal edge of the slabs 22 and 24. In resting on the temporary shims 28, it will be noted that the pads will compress and preform to accommodate all inconsistencies and irregularities of the railroad ties 16 and obviate the need for performing any special advance track preparation. The hold-down brackets 40 and end brackets 44 are then located on the bolts 36 and secured by the lock nuts 42. The grade crossing 10 may now be opened to traffic as the structure 20 is temporarily supported via the bracket assemblies 26. After a predetermined interval, depending on the characteristics of the grout or mortar, the pads 30 will cure or set whereby to subsequently support the deck 20 so that the wood shims 28 will thereafter serve no useful purpose.

The subject invention can also be utilized at grade crossings having a switching section of track as illustrated in FIG. 8. In this embodiment the switching section can be comprised of a primary set of running rails 60 and 62 and a switching set of running rails indicated generally at 64 and 66. A plurality of end slabs, in accordance with the previously described embodiments and similarly designated by the numeral 24, are disposed on the outer side of each of the rails 62 and 66. Specially formed center slabs, two of which are indicated generally at 68 and 70, are precast of a suitable shape for installation between adjacently spaced running rails 62 and 64, 64 and 60, 60 and 66, with all of the slabs being structurally equivalent and of comparable lengths and thicknesses in accordance with the slabs 22 and 24, previously described. The vehicular supporting deck for the switching section of track is assembled in the same manner previously described and provides the same advantages relative to the structures of the prior art.

In the exemplary structure illustrated in FIG. 9, the same basic techniques can be applied to a curved section of track. For clarity, the analogous slabs in FIG. 9 are designated by the same numerals used in FIGS. 2–6 with the addition of a double prime (″) suffix. In this embodiment, a pair of running rails 70 and 72 are formed on a radius of curvature which extends across the grade crossing. Accordingly, each of the modularly precast center and end slabs 22″ and 24″ are provided with marginal edges which are specially formed on a substantially identical radius of curvature whereby to provide an analogous structure relative to the vehicular supporting deck 20 and which can also be assembled in an identical manner as the structures previously described. Note, however, that in each of the last described embodiments, that all of the installations can be accomplished without any special advance track preparation nor is it necessary to install any special cross ties or special pre-fabricated shims. Note, further, that all of the embodiments are characterized by a common assembly technique and are provided with analogously formed precast modulars or slabs.

While it will be apparent that the preferred embodiments of the invention herein disclosed is well calculated to fulfill the objects above stated, it will be appreciated that the invention is susceptible to modification, variation, and change without departing from the proper scope or fair meaning of the subjoined claims.

What is claimed is:

1. A method of providing a railroad grade crossing for a railroad comprising a pair of running rails supported upon a plurality of spaced apart ties which in turn are supported upon a roadbed, which includes the steps of, selectively placing a plurality of shim elements adjacent one of said running rails and supporting said elements whereby the upper surfaces thereof lie along a predetermined imaginary plane arranged generally parallel to the upper surface of said running rail, selectively placing a plurality of deformable pads having a material which will harden in time adjacent said one running rail and locating the uppermost portions of said pads at least as high as said imaginary plane, orientating at least one precast slab adjacent said one running rail and above said shim elements and pads, and thereafter lowering said slab until it is supported above said roadbed upon said shim elements and simultaneously deforming said pads such that said uppermost portions thereof lie along said imaginary plane, and fixedly securing said slab to said one running rail and permitting the material of said pads to harden and thereby become a rigid support for said slab.

2. The method as set forth in claim 1 which includes the step of selecting said plane to be below the upper surface of said one running rail a distance approximately equal to the thickness of said slab.

3. The method as set forth in claim 1 which includes the step of securing said slab to said rail by detachable bracket means.

4. The method as set forth in claim 1 which includes the step of supporting said shim elements on selected of said ties.

5. The method as set forth in claim 1 which includes the step of supporting said pads on selected of said ties.

6. The method as set forth in claim 1 which includes the step of mixing mortar and filling deformable bags therewith and thereafter utilizing said bags as said pads.

7. The method as set forth in claim 1 which includes the step of precasting said slab with concrete and railroad rail stock.

8. The method as set forth in claim 1 which includes the steps of locating said elements and said pads adjacent the laterally outer sides of said running rails and placing two precast slabs thereon.

9. The method as set forth in claim 1 which includes the step of locating said elements and said pads between said running rails.

* * * * *